US007963425B2

(12) United States Patent
O'Connell White et al.

(10) Patent No.: US 7,963,425 B2
(45) Date of Patent: Jun. 21, 2011

(54) SHRINK SLEEVE FOR PUMP DISPENSER

(75) Inventors: Tami O'Connell White, Pleasanton, CA (US); Peddy Khatami, Pleastan Hill, CA (US)

(73) Assignee: The Clorox Company, Oakland, CA (US)

( * ) Notice: Subject to any disclaimer, the term of this patent is extended or adjusted under 35 U.S.C. 154(b) by 741 days.

(21) Appl. No.: 11/955,974

(22) Filed: Dec. 13, 2007

(65) Prior Publication Data

US 2009/0152136 A1 Jun. 18, 2009

(51) Int. Cl.
*B67D 5/06* (2006.01)

(52) U.S. Cl. ..... 222/205; 222/321.7; 222/321.8; 222/321.9; 53/427; 53/509; 206/223; 206/229

(58) Field of Classification Search ..... 222/205, 222/209, 1, 321.7, 565, 321.8, 330, 321.9, 222/372; 53/427, 509; 206/223, 229, 459.5
See application file for complete search history.

(56) References Cited

U.S. PATENT DOCUMENTS 2,774,517 A * 12/1956 Teegardin et al. ..... 222/205
3,263,871 A * 8/1966 Thompson ..... 222/205
3,841,532 A * 10/1974 Gores ..... 222/205
3,954,177 A * 5/1976 Faust ..... 206/432
4,051,265 A * 9/1977 Kirshenbaum et al. ..... 426/107
5,117,976 A * 6/1992 Whitt et al. ..... 206/705
5,186,900 A * 2/1993 Jensen et al. ..... 422/104
5,402,891 A * 4/1995 Haven et al. ..... 206/477
5,544,769 A 8/1996 Dowler
5,654,022 A * 8/1997 Sayre ..... 426/118
5,664,684 A 9/1997 Evert
5,961,004 A * 10/1999 DeMars ..... 222/205
6,020,823 A 2/2000 DeCicco
6,158,674 A * 12/2000 Humphreys ..... 239/333
6,406,653 B1 6/2002 Blackwelder et al.
6,669,021 B1 12/2003 Spielman
6,730,253 B2 5/2004 Etesse
6,736,562 B2 * 5/2004 Whitmore ..... 401/125
6,824,001 B2 11/2004 Johnson et al.
6,857,530 B2 2/2005 Yourist
6,880,313 B1 * 4/2005 Gessford et al. ..... 53/442
6,953,297 B2 * 10/2005 Dobbs et al. ..... 401/188 R
7,004,659 B1 * 2/2006 Goodman ..... 401/188 R
7,578,388 B2 * 8/2009 O'Connell et al. ..... 206/229
7,690,533 B2 * 4/2010 Stilley ..... 222/113
2003/0108698 A1 6/2003 Johnson et al.
2003/0168363 A1 9/2003 Molitor
2004/0011675 A1 1/2004 Miller
2004/0159567 A1 8/2004 Miziolek et al.
2005/0039416 A1 2/2005 Hidding
2005/0274687 A1 12/2005 McCutchan
2006/0096611 A1 5/2006 Leppla et al.
2007/0084545 A1 4/2007 Albenice et al.
2007/0087144 A1 4/2007 Albenice et al.
2009/0020535 A1 * 1/2009 Joubert et al. ..... 220/521

* cited by examiner

*Primary Examiner* — Frederick C. Nicolas
(74) *Attorney, Agent, or Firm* — David Peterson

(57) ABSTRACT

A shrink sleeve on a vertical pump-up dispenser covers a portion of the actuator, the container and the gap between the actuator and the container. The shrink sleeve may have upper and lower transparent portions to display properties of the dispenser and a middle portion to display product use information. The shrink sleeve may be removable via a tear strip so that the dispenser has an uncluttered appearance when used by the consumer.

4 Claims, 4 Drawing Sheets

SHRINK SLEEVE FOR PUMP DISPENSER

BACKGROUND OF THE INVENTION

1. Field of the Invention

This invention relates to shrink sleeves and shrink labels for dispensers, especially vertical pump-up dispensers. This invention relates to a labeling process for providing uncluttered dispensers.

2. Description of the Related Art

Bottles are widely used in consumer goods industry for packaging various types of fluid products. Such bottles are normally decorated, often using labels which are stuck onto the bottle. Such labels are typically used not only for decoration but also to display usage instructions or information on the composition of the contents, for example. However, conventional labeling technology such as wet glue labels, self-adhesive labels, or in mold labels do not allow for decorating the full bottle surface area. The accumulation of such visual signals led the industry to develop new approaches allowing higher decoration coverage of the container's surface, one of these new approaches being the shrink-sleeving of packages.

Shrink-sleeving is mostly used in the drinks industry, whereby a sleeve of thermoplastic material may be shrunk all around a beverage bottle, thus offering an extended area which may be used for any type of graphics. Typical thermoplastic materials used for shrink sleeving include polyvinylchloride (PVC); low or high density polyethylene (LDPE, HDPE); polyester terephthalate (PET); polypropylene (PP) and oriented polypropylene (OPP); polystyrene (PS) and oriented polystyrene (OPS); and mixtures thereof.

The unique shrink sleeve of the invention is used on a dispenser, for example a vertical pump-up dispenser and allows the consumer to see both the actuator top in its raised position and its relationship to the fluid container base so the consumer can understand how the dispenser works. Compared to a box or shroud designed to provide protection for the dispenser, the shrink sleeve welcomes and invites consumers to pick up the product if they are curious about the shape because there is nothing obstructing the consumer from holding the dispenser up for view. Since the consumer is invited to pick up the dispenser, the dispenser must be secured from inadvertent activation. While most shrink sleeves are designed to provide tamper evidence, the shrink sleeve of the invention can discourage the consumer from inadvertently activating the pump by pressing down on the pump actuator.

The shrink sleeve allows a broad area for consumer use and advertising information that can be removed to provide a more pleasant visual experience on the counter-top without the consumer information creating a cluttered visual experience. When the shrink sleeve is opaque in its middle section and transparent in the upper and lower regions, the consumer can see the product color below the label information and the actuator profile above the label information. Where the label contains EPA registration and required regulatory warnings, safety information, directions for use including bilingual directions, or other required labeling information, the shrink sleeve provides a cost-effective way of meeting all information requirements on shelf but provides premium and uncluttered aesthetics at home when it is removed.

U.S. Pat. App. 2007/0087144 to Albenice et al. describes typical use of shrink sleeves for labels and tamper-proof closures. U.S. Pat. App. 2007/0087144 to Albenice et al. discloses a decorated shrink sleeve. U.S. Pat. App. 2005/0274687 to McCutchen discloses a shrink sleeve label that covers a portion of the bottle, a portion of the cap and the gap between the bottle and the cap. U.S. Pat. App. 2005/0039426 to Hidding discloses the use of colored shrink sleeves to differentiate bottles from one another. U.S. Pat. App. 2004/0011675 to Miller discloses a shrink sleeve member surrounding the periphery of a unitized platform and product on which indicia may be printed. U.S. Pat. App. 2005/035081 to Fitch discloses a beverage bottle with a security collar connected to the skirt by a frangible portion.

To overcome these problems of dispensers of the prior art, the shrink sleeve on the dispenser of the present invention is designed to allow the consumer to pick up the dispenser on the store shelf without premature actuation, to conveniently identify the actuator top, the actuator skirt and the container base, to read the necessary product information, and to remove most of the product information so that the dispenser has an aesthetically pleasing appearance in the home.

SUMMARY OF THE INVENTION

In accordance with the above objects and those that will be mentioned and will become apparent below, one aspect of the present invention comprises a package for dispensing a fluid, the package comprising a dispenser and a shrink sleeve; the dispenser having a container base for the fluid, a pump assembly, and an actuator, wherein the pump assembly fluidly connects the container base with at least one orifice in actuator; wherein actuator is reciprocatedly attached to the top of the container base; the shrink sleeve covering at least a portion of the container base and a portion of said actuator, and wherein the shrink sleeve additionally covers a gap between the container base and the actuator.

In accordance with the above objects and those that will be mentioned and will become apparent below, another aspect of the present invention comprises a package for dispensing a product, the package comprising a dispenser and a shrink sleeve; the dispenser having a container base with a container bottom and container walls defining an interior compartment for storing a liquid, an actuator attached to the container base, wherein the actuator includes an actuator top having an actuator top surface and a indented actuator skirt wherein the actuator skirt slides inside the container walls, and a vertical pump assembly which fluidly connects the container base with the actuator top surface; the shrink sleeve covering at least a portion of the container base, at least a portion of the actuator, and the space between the actuator and the container base.

In accordance with the above objects and those that will be mentioned and will become apparent below, another aspect of the present invention comprises a shrink sleeve for covering a vertical pump-up dispenser having an actuator reciprocatedly connected to a container, the shrink sleeve comprising an upper transparent or translucent portion covering at least part of the actuator, an upper portion of the container, and a gap between the actuator and the container; a lower opaque or translucent portion covering a middle portion of the container; wherein the lower portion is more opaque than the upper portion.

In accordance with the above objects and those that will be mentioned and will become apparent below, another aspect of the present invention comprises a process for providing an uncluttered consumer dispenser comprising providing a dispenser relatively free of directions for use; attaching to the dispenser a shrink sleeve having a frangible tear strip so that the shrink sleeve is completely removable from the dispenser; wherein the shrink sleeve contains the directions for use and other product information.

BRIEF DESCRIPTION OF THE DRAWINGS

In the accompanying drawings that form part of the specification, and in which like numerals are employed to designate like parts throughout the same.

DETAILED DESCRIPTION OF THE INVENTION

Figure 1:
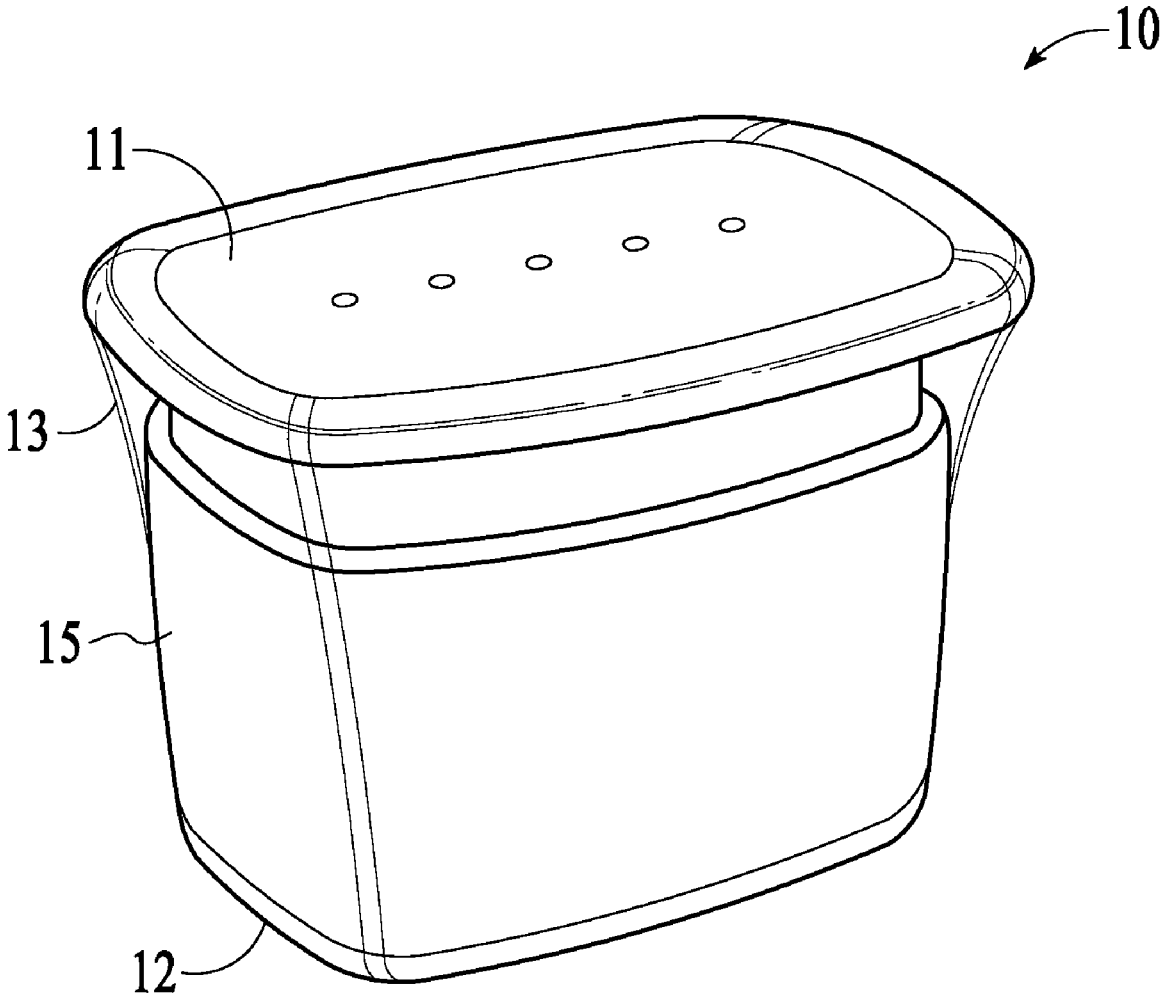
FIG. 1 is a perspective view of a package of the invention.

While this invention is susceptible of embodiment in many different forms, this specification and the accompanying drawings disclose only some specific forms as examples of the invention. The invention is not intended to be limited to the embodiments so described. It is also to be understood that the terminology used herein is for the purpose of describing particular embodiments of the invention only, and is not intended to limit the scope of the invention in any manner. The scope of the invention is pointed out in the appended claims.

For ease of description, the components of this invention and the container employed with the components of this invention are described in the normal (upright) operating position, and terms such as top, bottom, upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

It should be understood that every limit given throughout this specification will include every lower, or higher limit, as the case may be, as if such lower or higher limit was expressly written herein. Every range given throughout this specification will include every narrower range that falls within such broader range, as if such narrower ranges were all expressly written herein.

The term "plastic" is defined herein as any polymeric material that is capable of being shaped or molded, with or without the application of heat. Usually plastics are a homo-polymer or co-polymer that of high molecular weight. Plastics fitting this definition include, but are not limited to, polyolefins, polyesters, nylon, vinyl, acrylic, polycarbonates, polystyrene, and polyurethane.

Package

FIG. 1 illustrates a perspective view of a vertical pump-up dispenser 10 having a shrink sleeve 15 covering the actuator 11, the container base 12 and the gap 13 between the actuator 11 and the container base 12. The shrink sleeve 15 also covers part of the actuator top surface.

Figure 2:
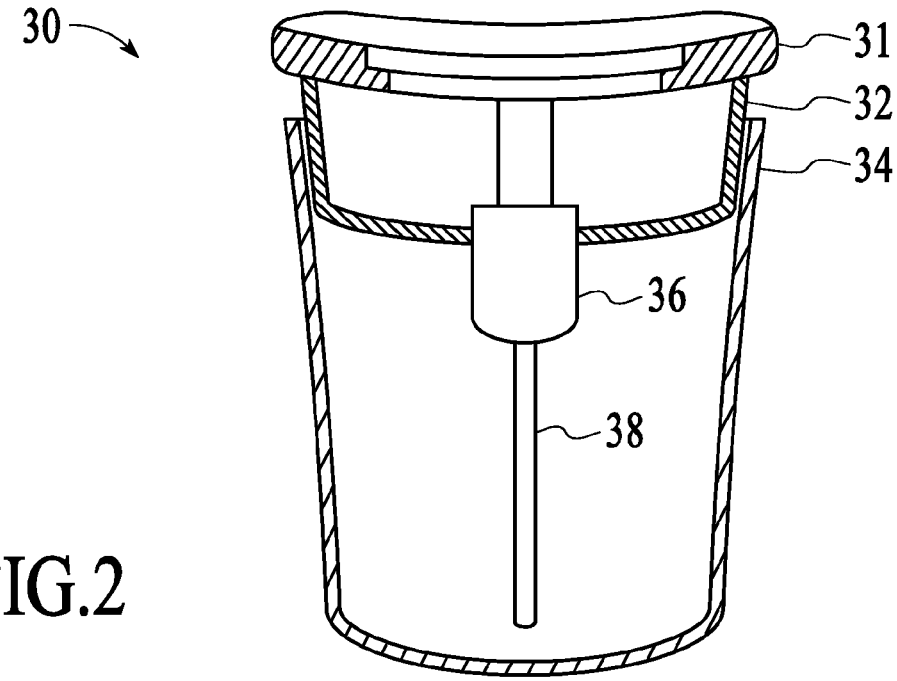
FIG. 2 is a front cross-sectional view of a dispenser of the invention.

FIG. 2 illustrates a front cross-sectional view of a vertical pump-up dispenser 30 (as described in U.S. patent application Ser. No. 11/551,836 and specifically incorporated by reference herein) employing an actuator 31 having an indented interior skirt 32 that slides inside the container base 34. The dispenser 30 also includes a pump assembly 36, and a dip tube 38. When the actuator 31 is pushed down, the pump assembly 36 delivers fluid to the top surface of the actuator 31. Reciprocation (or continued pushing down and allowing the actuator to return to the up position) of the actuator allows continual delivery of fluid to the actuator surface.

Figure 3:
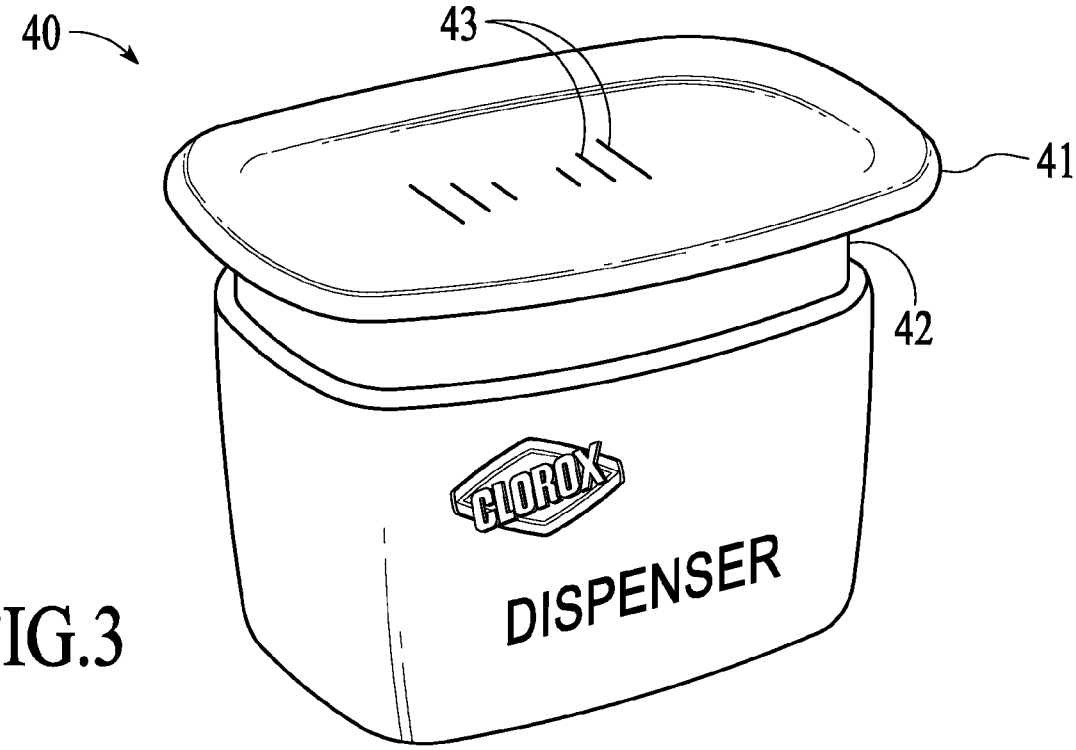
FIG. 3 is a perspective view of a dispenser of the invention.

FIG. 3 illustrates a perspective view of a vertical pump-up dispenser 40 having an indented interior skirt 42 and showing slotted orifices 43 on the top surface of the actuator 41 to deliver a cleaning composition or other liquid. The dispenser 40 has an uncluttered consumer friendly appearance and is relatively free of direction for use, for example, it may only have simple branding and naming (including Trademarks) embossed on the dispenser, as in FIG. 3.

Figure 4:
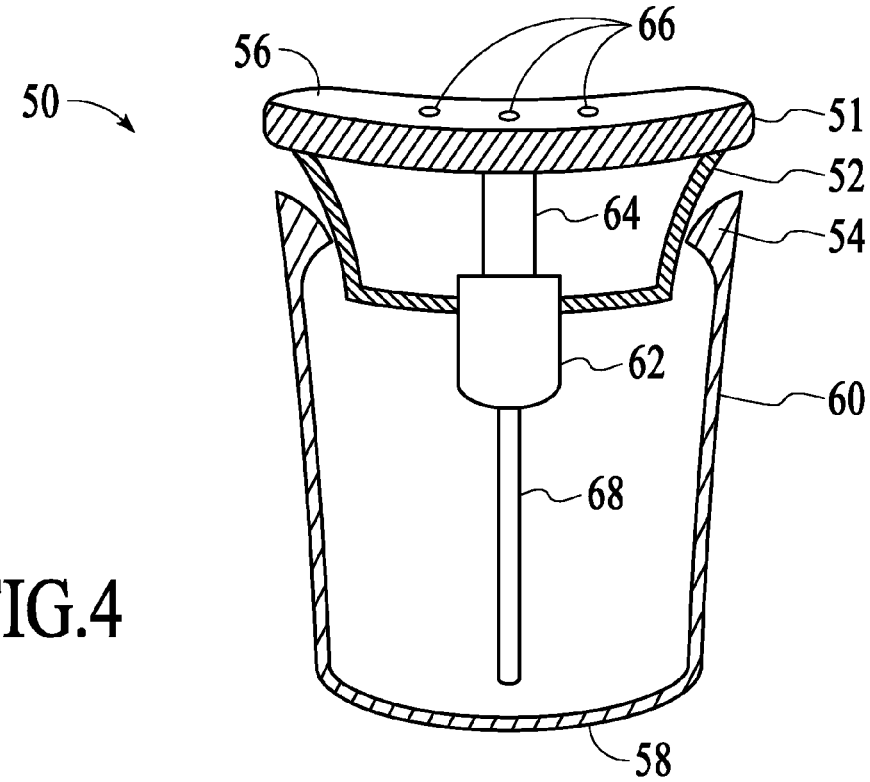
FIG. 4 is a front cross-sectional view of a dispenser of the invention.

FIG. 4 illustrates a front cross-sectional view of one embodiment of the invention showing dispenser 50 having an actuator 56 with an actuator top 51 and a curved, concave interior skirt 52 coupled to the actuator top 51 and depending downwardly from the actuator top 51. The container base 54 has a container bottom 58, a container sleeve 60 coupled to the container bottom 58 and depending upwardly from the peripheral edge of the container bottom 58. The dispenser 50 has a pump assembly 62 having a hollow stem 64 and the pump assembly 62 disposed within the container base 54 and in fluid communication with the actuator 56; wherein the actuator 56 has at least one discharge orifice 66 in fluid communication with the stem 64 of the pump assembly 62 to permit liquid to flow on to a top surface of the actuator top 51 upon reciprocation of the actuator top 51; wherein a sleeve interior surface of the container sleeve 60 is slideably engagable with a skirt exterior surface of the actuator skirt 52; and wherein the actuator skirt 52 forms a concave curve It will be appreciated that the particular design of the pump assembly 62 may be of any suitable design for pumping a product from the container 54 (with or without a dip tube 68) and out through the stem 64 having a fluid distribution system (not shown) connected to orifices 66. The detailed design and construction of the pump assembly 62 forms no part of the present invention except to the extent that the pump assembly 62 is adapted to be suitably mounted and held on the container by a closure with a suitable mounting system.

Figure 5:
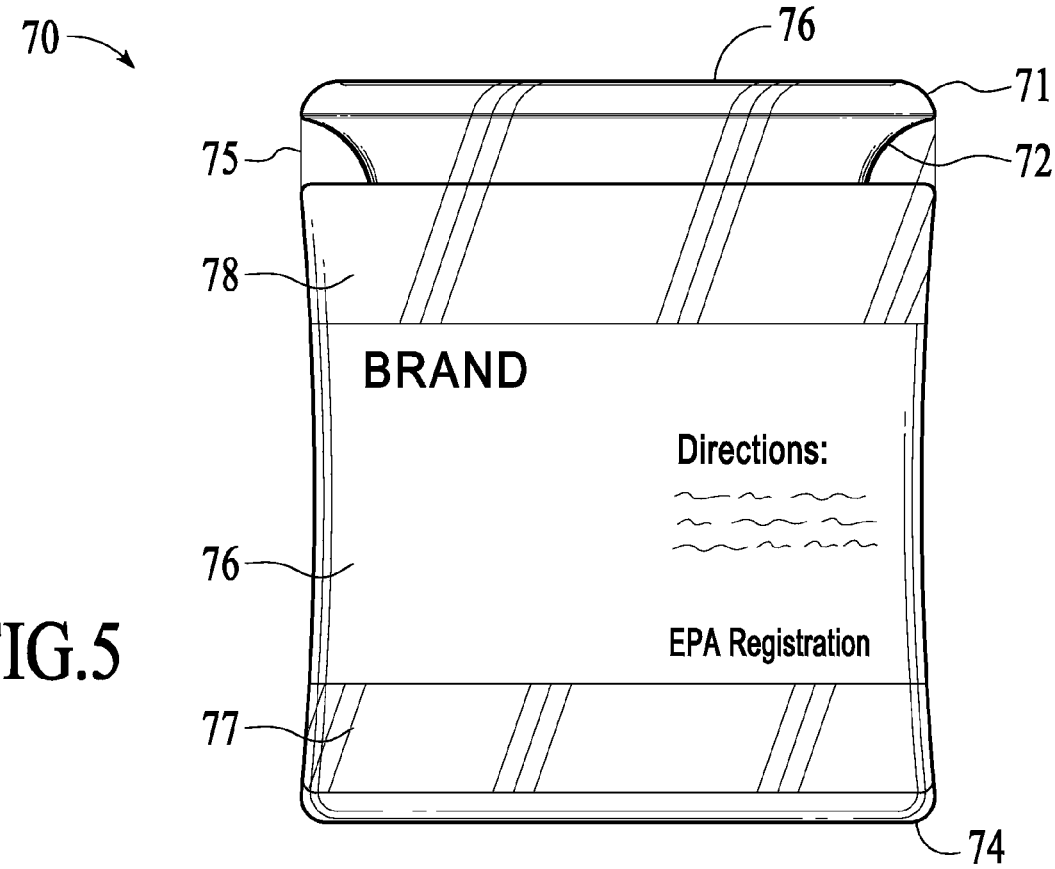
FIG. 5 is a front view of an embodiment of a package of the present invention.

FIG. 5 illustrates a front view of an embodiment of the invention showing dispenser 70 having an actuator 76 with an actuator top 71 having a curved, concave interior skirt 72 coupled to the actuator top 71 and depending downwardly from the actuator top 71 above the container base 74. The container base 74 has a concave container wall depending upwardly from the container bottom. Shrink sleeve 75 covers a portion of the container 74 and the actuator top 71 over a portion of the actuator top surface and the gap between the actuator top 71 and the container base 74. The shrink sleeve 75 has an opaque or translucent central portion 76 containing branding and other product information, such as directions for use including bilingual directions (English and another language other than English such as Spanish), safety information, and regulatory information such as an EPA registration number. The shrink sleeve has a transparent or translucent lower or bottom section 77 that allows the consumer to identify the color of the liquid inside the container. The shrink sleeve 75 contains a transparent or translucent upper section 78 that allows the consumer to see how the actuator 76 interacts with the container base 74. The upper section 78 of the shrink sleeve 75 can also provide protection against premature activation of the dispenser, even while allowing the consumer to handle the dispenser. The central portion 76, while it may be in some embodiments be translucent, is more opaque than the upper section 78.

Specific examples of product information that can be conveyed on the shrink sleeve includes, but is not limited to, appropriate uses, such as Kitchen Surfaces, Bathroom Surfaces, Household Surfaces, Hospital Surfaces, Dishes, Skin Surfaces; germ claims, such as "Kills 99.9% of Germs"; lists of germs, such as Pseudomonas, *Staphylococcus, Salmonella,* Herpes, Influenza, Hong Kong virus; product quantity claims, such 12 FL OZ (354 ml); active ingredient listings, such as 0.3% alkyl dimethylbenzylammonium chloride; safety information, such as KEEP OUT OF THE REACH OF CHILDREN or CAUTION or CAUSES MODERATE EYE IRRITATION; pictorials of product usage, such as a hand and cleaning substrate pushing down on the dispenser; consumer contact information, such as question or comment call numbers or web contact information; Directions for Use, such as To Operate, To Use, To Sanitize, To Disinfect; Precautionary Statements, such as Hazards to Humans and Domestic Animals; STORAGE AND DISPOSAL information; and repetition of some or all of this information in an additional language, such as Spanish. Because this is important information to convey to the consumer, but after considering this information the consumer may wish to remove this information when placing the dispenser in a prominent place for use, it is convenient to have a removable shrink sleeve or shrink label that accomplishes multiple tasks.

Figure 6:
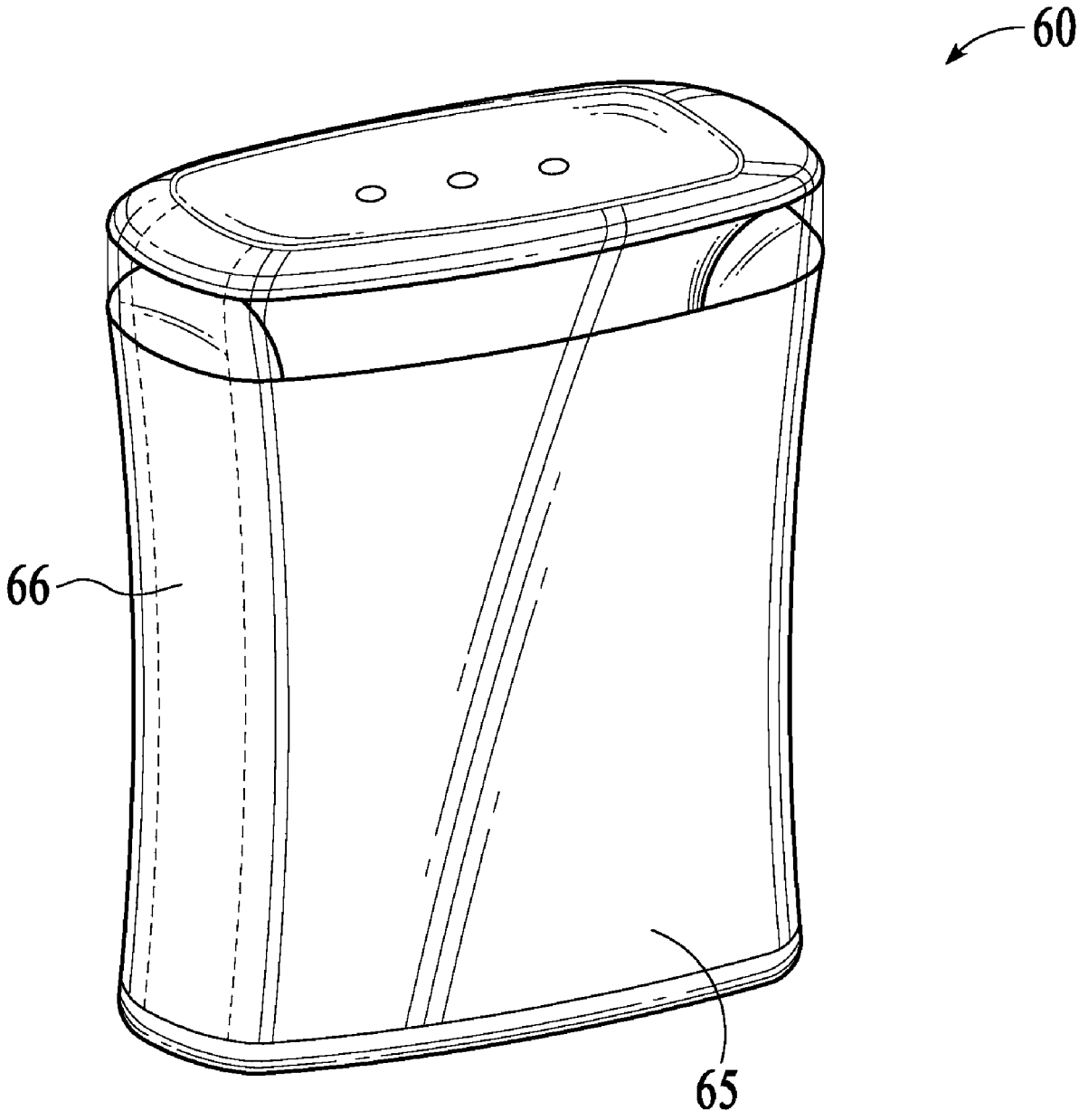
FIG. 6 is a perspective view of an embodiment of a package of the present invention.

FIG. 6 illustrates a perspective view of an embodiment of the invention showing dispenser 60 covered by shrink sleeve 65 where the shrink sleeve 65 has a frangible strip 66 down the entire vertical length of the shrink sleeve 65. Tearing the frangible strip 66 allows for removal of the shrink sleeve 65 from the dispenser 60.

While the present invention may be practiced with spray or liquid pumps of many different designs, the internal design configuration of one suitable pump is generally disclosed in U.S. Pat. No. 4,986,453, the disclosure of which is hereby incorporated herein by reference thereto. Suitable dispensers are described in U.S. patent application Ser. Nos. 11/551,822, 11/551,830, 11/551,836, 11/609,740, 11/609,749, 11/609,761, 11/621,235, 11/742,674, and 11/876,395, the disclosures of which are hereby incorporated herein by reference thereto. It should be understood, however, that the present invention is suitable for use with a variety of hand-operable pumps and dispensers.

The container, and other components of the dispenser package, can be constructed of any of the conventional material employed in fabricating containers, including, but not limited to: polyethylene; polypropylene; polyacetal; polycarbonate; polyethylene terephthalate; polyvinyl chloride; polystyrene; blends of polyethylene, vinyl acetate, and rubber elastomer. Other materials can include stainless steel and glass. In a suitable embodiment, the container is made of clear material, e.g., polyethylene terephthalate.

Shrink Sleeve

The shrink label of the present package generally comprises a film label printed on an oriented plastic sheet or tube, which, when heat is applied to the label, conforms to the contour of the container that it surrounds. There are generally two types of shrink sleeves known in the art: (1) shrink-sleeve labels, and (2) roll-fed, wrap-around labels. A shrink-sleeve label is generally a tubular structure defining a longitudinal direction and a transverse direction and made of a heat shrinkable film and having an open top and an open bottom.

The shrink-sleeve label is generally sized such that the diameter of its tubular structure is great enough to slip over the bottle and cap to which it is intended to be applied. The length of the tubular structure is long enough to cover at least a portion of the bottle and a portion of the cap after the shrink label is shrunk onto the bottle and cap. Once the shrink-sleeve label is slipped over the bottle and cap, heat is then applied to shrink the shrink label to the bottle and cap.

The shrink label is typically made of an oriented film material. An oriented film material is generally a film material having the greatest shrinkage in a defined direction, usually the transverse direction in a shrink-sleeve label and perpendicular to the longitudinal direction of the shrink-sleeve label. Non-limiting examples of suitable film materials include polyvinyl chloride, polyethylene, polypropylene, other polyolefins and copolymers, polyesters, polystyrene, and combinations thereof (e.g. a laminated film material). A preferred film material for the shrink label of the present invention is polyethylene terephthalate. The thickness of the film material for the shrink label is generally from about 30 to about 100 microns, preferably from about 40 to about 50 microns. A preferred film material for the shrink label of the present invention has a thickness of 50 microns. A suitable film material for the shrink label of the present invention is available from American Fuji Seal, Inc. under the trade name FVK-350. The film material for the shrink label can be pre-printed with graphics, text, etc. at any desired location on the film material. A variety of printing methods can be utilized to print graphics onto the shrink labels, including gravure (or rotogravure) printing and flexographic printing. A preferred printing method is gravure printing. The film material can also be coated with protective layers, such as varnishes, for scuff resistance or to control the coefficient of friction of the film material to facilitate the slipping of the shrink label onto the bottle and cap.

The shrink label can be perforated to facilitate applying the shrink label to uniquely shaped bottles. The shrink label can also be perforated to facilitate removal of the shrink label after the product is used up or to improve container esthetics before the product is used, or to allow for proper recycling of materials. However, the shrink label of the present invention is preferably perforated to facilitate removal of the shrink label by a consumer before use of the product. For example, the shrink label is preferably perforated around the entire perimeter of the shrink label or preferably perforated across an entire surface parallel to the longitudinal axis of the shrink label.

The following is a description of the process for applying a shrink-sleeve label to a dispenser of the present invention. Most shrink labels are made of oriented plastic films that shrink around a container when heat is applied. They can be made of flat film material that is stretched (oriented) and seamed, or from tubular film material that is stretched in the blowing process. The degree to which a shrink label shrinks is determined when the film material is stretched. In effect, stretching the film material programs "memory" into the material. That memory is recalled by applying heat after the shrink label is slipped onto the container and the film material shrinks. Shrink-sleeve labels can be supplied as individual, pre-cut sleeves or in continuous rolls which are then cut automatically before being applied to the container.

In the process of applying a shrink-sleeve label to a dispenser, the shrink-sleeve label is placed loosely around the article. The shrink-sleeve label is sized just large enough to allow it to be placed over the length of the article, either manually or by automated high-speed application machinery. The film material of the shrink-sleeve label shrinks as the article passes through a heat tunnel, where heat is applied via, for example, hot air or steam or other similar method (e.g., radiant heat). In the heat tunnel, the film material softens, causing it to seek its original, smaller dimensions, and, in the process, to shrink tightly around the article. Different time and temperature profiles are required for different shrink film materials, thicknesses, and bottle and cap shapes and materials. The heat tunnels may have several "zones" where heat (e.g., hot air or steam) is directed sequentially to different parts of the container at different times and temperatures in order to effectively apply the shrink-sleeve label to the dispenser.

Compositions

The dispenser can be used to transfer a wide variety of compositions to a substrate. These compositions include, but are not limited to, hard surface cleaners and sanitizers, personal care cleaners and other products, hand sanitizers, dish soap, laundry pre-treater, food products such as marinades, car products such as cleaners or protectants, and baby care products such as baby lotion.

Methods of Use

Consumers enjoy the ease of use of the invention for reasons such as it utilizes cleaners differently, provides control such as no overspray, can be used one-handed, is compatible with wide variety of substrates, utilizes direct application so that no particles are aerosolized into the air, allows easy multi-tasking with other household activities, and is not limited by number of doses or wipes. Because of this flexibility, the consumer has more control to make the exact use conditions suitable to the task.

The dispensing package can be used as a one-handed method of cleaning a surface, where the consumer grabs a substrate in her hand, pushes the substrate down on the actuator top of the dispensing package with her hand, allows the actuator top to come up and discharge a cleaning composition from the dispensing package to the substrate, and wipes the surface with the substrate. The substrate can be a paper towel, facial tissue, sheet of toilet tissue, a napkin, a sponge, a towel, or any other suitable woven or nonwoven substrate. Because the cleaning task takes only one hand, the other hand is free to perform another activity, such as holding a telephone, eating a snack and the task can be done quickly and easily without carrying the dispensing package to the area of the task.

Because the consumer is unfamiliar with the one-handed method of cleaning a surface, certain use indications can be supplied as directions for use of the dispensing package, however, proper utilitarian design of the dispensing package makes its use intuitive. One example of the components of the device allowing for intuitive use is having a concave, rather than a slanted or vertical actuator skirt.

While this detailed description includes specific examples according to the invention, those skilled in the art will appreciate that there are many variations of these examples that would nevertheless fall within the general scope of the invention and for which protection is sought in the appended claims.

What is claimed is:

1. A package for dispensing a product, the package comprising a dispenser and a shrink sleeve; the dispenser having a container base with a container bottom and container walls defining an interior compartment for storing a liquid, an actuator attached to the container base, wherein the actuator includes an actuator top having an actuator top surface and an indented actuator skirt wherein the actuator skirt forms a concave curve and slides inside the container walls, and a vertical pump assembly which fluidly connects the container base with the actuator top surface; the shrink sleeve covering at least a portion of the container base, at least a portion of the actuator, and the gap between the actuator and the container base.

2. The package of claim 1, wherein the shrink sleeve extends over at least a part of the actuator top surface.

3. The package of claim 1, wherein the pump assembly has a hollow stem and the pump assembly is disposed within the container and in fluid communication with the actuator; and wherein the actuator has at least one discharge orifice in fluid communication with the stem of the pump assembly to permit liquid to flow on to a top surface of the actuator top upon reciprocation of the actuator top.

4. The package of claim 1, wherein the shrink sleeve provides a barrier to pushing down on the actuator.

* * * * *